US005421061A

United States Patent [19]

Kölle et al.

[11] Patent Number: 5,421,061

[45] Date of Patent: Jun. 6, 1995

[54] CONCEALED FASTENING OF A VEHICLE DOOR HANDLE

[75] Inventors: Rudi Kölle, Sindelfingen; Bruno Stenzel, Böblingen; Martin Lindmayer, Leonberg; Peter Kolb, Bad Liebenzell, all of Germany

[73] Assignee: Mercedes Benz AG, Stuttgart, Germany

[21] Appl. No.: 116,754

[22] Filed: Sep. 7, 1993

[30] Foreign Application Priority Data

Sep. 8, 1992 [DE] Germany ..... 42 29 930.6

[51] Int. Cl.[6] ..... A47B 95/02

[52] U.S. Cl. ..... 16/114 R; 16/112

[58] Field of Search ..... 16/114 R, 110 R, 112, 16/DIG. 24

[56] References Cited

U.S. PATENT DOCUMENTS

| | | | |
|---|---|---|---|
| 4,038,718 | 8/1977 | Reilhac et al. | 16/115 |
| 4,497,514 | 2/1985 | Moriya et al. | 16/112 |
| 4,653,143 | 3/1987 | Ketelhut et al. | 16/112 |
| 4,818,003 | 4/1989 | Seko et al. | 16/112 |

FOREIGN PATENT DOCUMENTS

| | | | |
|---|---|---|---|
| 109287 | 4/1968 | Denmark | 16/114 R |
| 4024003 | 10/1991 | Germany . | |

*Primary Examiner*—Mark Rosenbaum
*Assistant Examiner*—Chuck Y. Mah
*Attorney, Agent, or Firm*—Evenson McKeown Edwards & Lenahan

[57] ABSTRACT

The invention relates to a concealed fastening of a door handle on a panelling of a vehicle door, vehicle flap or the like, with a handle plate which rests on the panelling and which has, in a fastening region, a hook arm which projects from its rear side and passes through a clearance in the panelling and which is pushed, with an end region engaging behind, onto a support bearing arranged movably on the rear side of the panelling. The end region is held at a distance from the engaged behind counterface of the support bearing and rests with a spacer means on the counter face of the support bearing, and the distance between a pressure face of the spacer means loading the support bearing and the end region being variably changeable in order to compensate production tolerances. In order to allow a quicker mounting of the door handle without any loss of mounting accuracy, the spacer means is arranged on the hook arm so as to be displaceable transversely to the counter face of the support bearing and is held under a spring load in its bearing position on the support bearing.

10 Claims, 2 Drawing Sheets

CONCEALED FASTENING OF A VEHICLE DOOR HANDLE

BACKGROUND AND SUMMARY OF THE INVENTION

The invention relates to a concealed fastening of a door handle on a panelling of a vehicle door, vehicle flap or the like.

Such a fastening of a door handle is known from U.S. Pat. No. DE 4,024,003 Cl and makes it possible to mount and dismount the door handle from outside, that is to say without removing the door interior trim.

The known door handle comprises a handle-recess plate which forms the handle recess and on which a swingout handle lever is mounted and in which a lock cylinder is fastened. For the attachment of this constructional unit, there projects from the rear side of the handle recess plate in the front end region a hook arm which can be inserted through a clearance in the exterior panelling and which, when the door handle is subsequently displaced longitudinally, slides, with an end region engaging behind, onto a holding plate which projects from the exterior panelling and which, at the same time, is bent obliquely rearwards towards the inside of the door. There projects from the rear side of the handle-recess plate in the rear end region a wedge-shaped holding flange which can likewise be inserted through a clearance in the exterior panelling and which can subsequently be screwed, through an orifice in the end face of the door, together with an angled leg of the exterior panelling.

The door handle is thus connected to the door body in a manner stable under tension by means of a single fastening screw. In order to allow compensation of production tolerances during the mounting of the door handle, there passes through the end region of the hook arm engaging behind, at fight angles to the plane of the holding plate behind which it engages, a threaded bore, into which is screwed an adjusting screw, the threaded shank of which projects from the end region and rests with its end on the holding plate. So that the end of the adjusting screw can slide more easily onto the holding plate during the longitudinal displacement of the door handle, the threaded shank is bevelled at the end on one circumferential side. Since the end region of the hook arm is to engage behind the holding plate in a manner essentially free of play, but on the other hand the door exterior panelling should not be subjected to bulging stress and even damage to the enamelled holding plate caused by scratching must be avoided in view of the risk of corrosion, an adjustment of the hook-fastening point is relatively time-consuming. This is true all the more so because, when the fastening screw is being tightened, the door handle can also experience a longitudinal advance which is also associated with a further advance of the end region in relation to the holding plate.

An object on which the invention is based is to improve a concealed fastening of a door handle on a panelling of a vehicle door, vehicle flap or the like, of the type indicated above to the effect that a quicker mounting of the door handle becomes possible without any loss of mounting accuracy.

The solution according to the invention for achieving this object is to provide an arrangement wherein the spacer is arranged on the hook arm so as to be displaceable transversely to the counter face of the support bearing and is held under a spring load in its bearing position on the support bearing. As a result of the continuously displaceable arrangement of the spacer in conjunction with the spring load of the latter, a playfree engagement behind the support bearing is obtained automatically during the mounting.

So that no instabilities can be detected at the support-bearing point during the normal operation of the door handle, the spring force of the load spring is expediently selected so high that it overrides the tensile forces occurring on the support bearing during a customary operation of the door handle.

Extreme tensile loads on the door handle, such as have to be exerted, for example, when the door is jammed as a result of an accident, can, if the need arises, be supported by the spring if this comes to a block. However, a more compact and also more cost-effective construction at the support-bearing point becomes possible if, after an intended spring excursion of the load spring has been used up, at least part faces of the end region of the hook arm engaging behind bear on the support bearing in a bearing position.

In one embodiment of the invention, a tappet is slidably guided in an annular guide of the end region and is loaded axially via a helical compression spring. At the same time, a complete integration of the tappet arrangement in the cross-section of the end region is possible. However, the manufacturing outlay in the production of the end region is considerable. Also, as seen in cross-section, the end region has to be made of relatively large size, in order to allow the tappet end to be supported over a large area.

More favorable conditions are obtained in an alternative version of the spacer, in which a slide is guided on a sliding guide of the end region and forms an engaging-behind part region of the end region. Moreover, a simple and rapid attachment of the slide on the sliding rail by snapping on can become possible if the slide is made of flexurally elastic material.

DETAILED DESCRIPTION OF THE DRAWINGS

Figure 1:
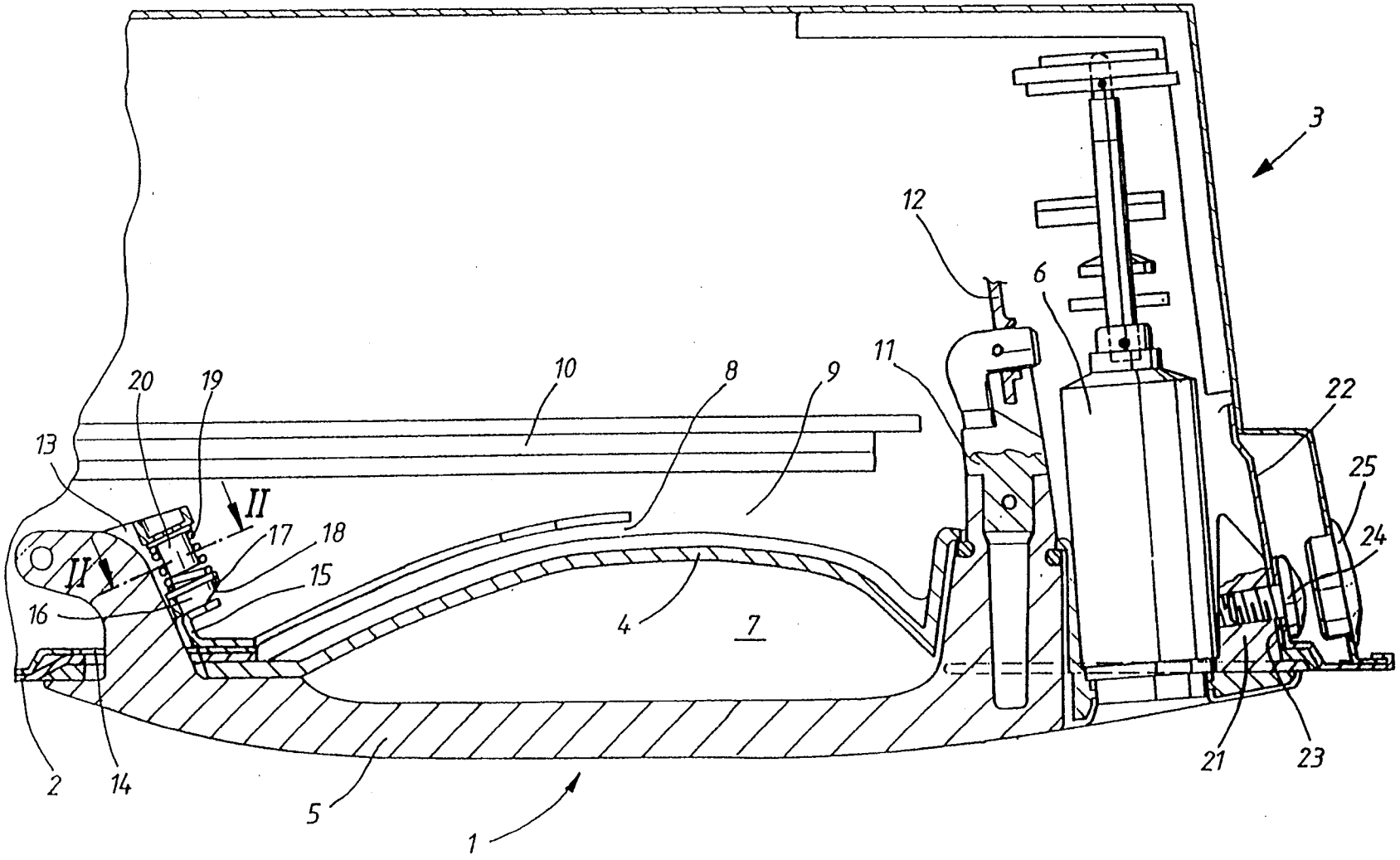
FIG. 1 is a schematic sectional view which shows a middle longitudinal section through a door handle fastened on a panelling of a vehicle door, constructed according to a preferred embodiment of the present invention.

FIG. 1 shows a door handle 1 which is fastened in a concealed manner on a door exterior panel 2 of a side door 3, designed as a hollow body, of a motor vehicle not shown. As operating elements of the door handle 1 extending horizontally forwards in front of a rear door end wall, a swing-out handle bar 5 and a lock cylinder 6 are guided in succession, in clearance of a handle plate 4 carrying the door handle 1, through which clearances they pass transversely. Over the length region of the handle bar 5 to be encompassed, the handle plate 4 is recessed to form a handle recess 7 and is countersunk as a whole in a depression 8 of the door exterior panel 2, there being cut out from the recessed region of the door exterior panel 2, behind the middle of the handle recess 7, a perforation 9 which extends virtually as far as the rear end of the depression 8. Behind a disc 10 which can be countersunk in the side door 3, there first projects through the perforation 9 a release shank 11 which is connected to the angled rear end of the handle bar 5 and which engages with a transversely rearward-projecting lug, into an associated insertion orifice of a lock-release lever 12. Behind it, the lock cylinder 6 is fastened in the associated clearance of the handle plate 4, its cylinder core being connected via an articulated rotary rod to a retaining lever of a lock not shown.

Figure 2:
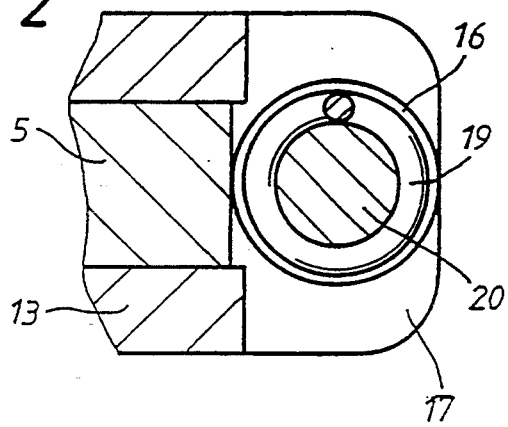
FIG. 2 is a cross-sectional view through a hook arm of a handle plate along the line II—II in FIG. 1.

To fasten the door handle 1 at its from end 5 invisibly from outside, there projects from the rear side of the handle plate 4 a hook arm 13 which, through a long hole 14 in the door exterior panel 2, engages behind a rearwardly bent holding plate 15 by means of a rearwardly angled end region. The holding plate 15 consists of a doubly folded sheet-metal strip which is bent as a whole in an approximately U-shaped manner and one leg of which is welded directly behind the long hole 4 onto the inside of the recessed door exterior panel 2. At the same time, the leg of the holding plate 15 behind which there is engagement extends obliquely inwards at an angle of approximately 25° to the door plane, with the result that it forms an inclined slide-off plane for the end region of the hook arm 13. One end of a tappet 16 bears with its pressure face on the slide-on plane of the holding plate 15 serving as a support bearing and is guided slidably at right angles to the slide-on plane in the end region of the hook arm 13. For the axial sliding guidance of the tappet 16, the latter slides in a coaxial clearance of an annular guide 17 which forms a part of the end region engaging behind the slide-on plane at a short distance. The clear cross-section of the continuous clearance in the annular guide 17 is made rotationally asymmetric in coordination with the tappet cross-section, thereby preventing the tappet 16 from rotating in the annular guide 17. The tappet end projecting from the annular guide 17 is bevelled on the circumferential side facing rearwards, to form a slide-on plane 18 which forms an acute angle with the slide-on plane of the holding plate 15. The tappet 16 is spring-loaded in the direction of the holding plate 15 by a helical compression spring 19 integrated into the end region of the hook arm 13 and having a cylindrical winding, with the result that the tappet 16 is held in its pushed-out position. At the same time, one end of the helical compression spring 19 is supported on an annular collar of the tappet 16 which is supported axially on the inner end of the annular guide 17 in order to limit the push-out travel of the tappet 16. As can be seen in conjunction with FIG. 2, the prestressed helical compression spring 19 is supported at its other end on the annular collar of a coaxially arranged guide sleeve 20 which is itself inserted into a bore of the end region and which prevents the spring winding from escaping radially.

At the rear end, the door handle 1 is fastened in a concealed manner via a screw-fastening point. For this purpose, there projects from the rear side of the handle plate 4 a holding flange 21 which has a wedge-shaped end and through which a threaded bore passes transversely and which bears with its rear side against a plate leg 22 of a lock plate. The bendable plate leg 22 is clamped between the holding flange 21 and a support plate 23 consisting of a sheet-metal strip of the door exterior panel 2, the said sheet-metal strip being bent towards the inside of the door and rearwardly limiting the perforation on opening 9. A fastening screw 24 is screwed into the threaded bore through bores in the plate leg 22 and in the support plate 23 aligned with the threaded bore of the holding flange 21 and firmly connects the holding flange 21, together with the clamped plate leg 22, to the support plate 23. At the same time, the screw-fastening point is accessible through an orifice in the door end wall, the said orifice being closed by means of a dummy plug 25. The rear screw fastening thus accords exactly with the rear fastening of the previously known door handle.

When the door handle 1 is being attached to the door exterior panel 2, it is first offered approximately at right angles to the door plane and is inserted through the lock hole 14, with the forwardly angled bearing point of the handle bar 5 on the hook arm 13 in front, whereupon, after the pivoting of the door handle 1, the hook arm 13 is first displaced forwards in the long hole 14 about a vertical axis. Subsequently, the door handle 1 is displaced rearwards in its longitudinal direction relative to the door exterior panel 2, the slide-on plane 18 running on the pressure face of the holding plate 15 and, during the further rearward displacement of the door handle 1, causing the tappet end to slide onto the pressure face of the holding plate 15. Depending on the tolerance position of the structural elements thereby hook-connected, there is a more or less large axial advance of the tappet 16 opposite to its spring-loading direction, with the result that it is pushed a corresponding distance into the annular guide 17. This results, irrespective of any tolerance, in a play-free hook connection which is also maintained when, during the tightening of the fastening screw 24, the door handle 1 is displaced longitudinally even further rearwards.

The spring force of the helical compression spring 19 is calculated in such a way that, during the normal swing-out of the handle bar 5 about its bearing point arranged on the hook arm 13, the tappet 16 does not vary its position of penetration in the annular guide 17. Only when very high forces take effect on the handle bar 5, for example because the side door 3 is jammed in the door frame, is the spring force overridden, with the result that the annular guide 17 moves nearer to the holding plate 15 and finally also rests on the pressure face of the latter. The positional stability of the hook arm 13 is thereafter no longer limited by the spring, but depends only on the shearing resistance of the annular guide 17 or on the resistance of the holding plate 15 serving as a support bearing.

Figure 3:
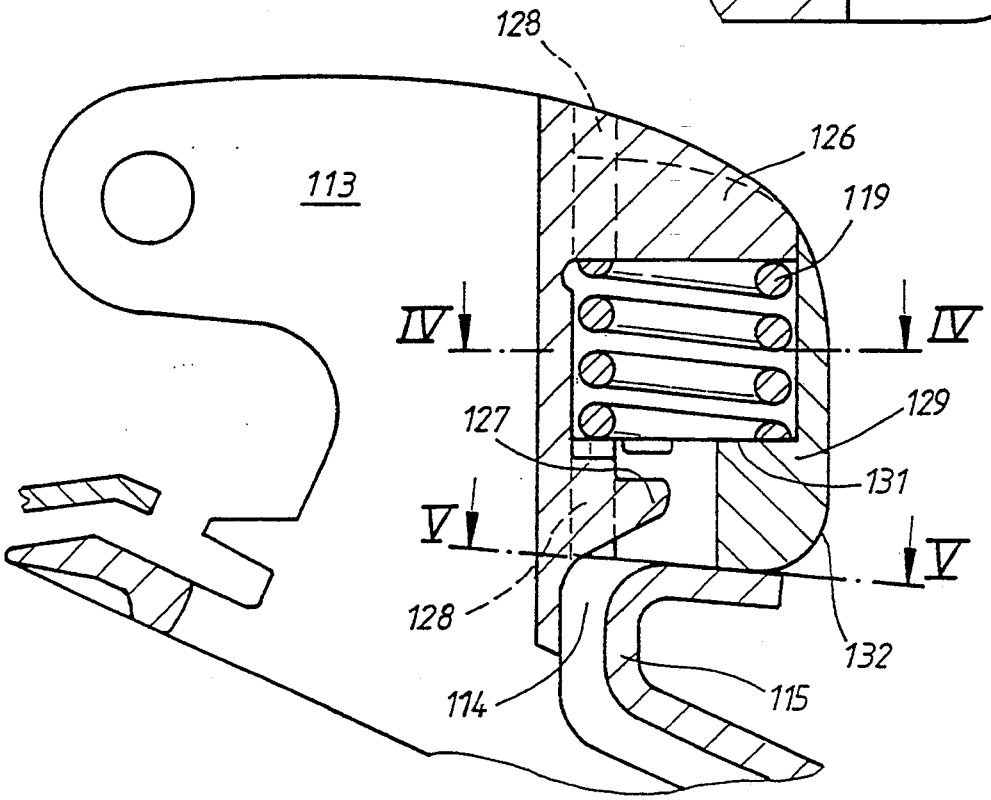
FIG. 3 shows a middle longitudinal section through an alternative version of a hook arm in its installation position.
Figure 4:
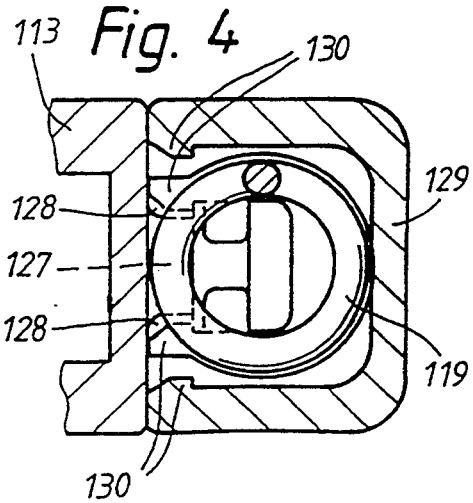
FIG. 4 shows a cross-section corresponding to the sectional line IV—IV in FIG. 3.
Figure 5:
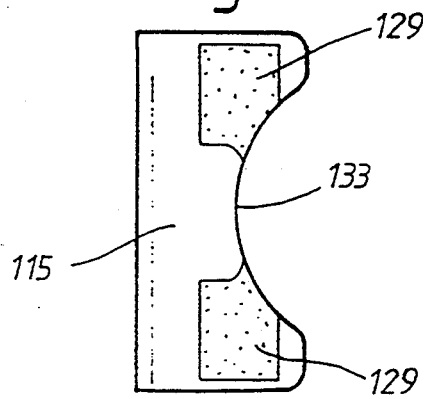
FIG. 5 shows a top view of the loaded support beating.

The sectional representations according to FIGS. 3 and 4 show an alternative version to the above described hook-connection principle of the door handle 1, this alternative version achieving, among other things, an improved tilting support of the door handle 1. The representation of the fastening concept, otherwise identical to the door handle 1, have been limited to the hook-connection region. Furthermore, to simplify the further description, the reference symbols already introduced have been used for functionally identical structural elements and identified simply by adding "100" to the reference numbers.

Instead of two annular guides, there project from the hook arm 113 two mutually spaced guide plates 126 and 127 which have a rectangular cross-section differing from one another and which together form a sliding rail for a slide 129 engaging around the latter on the outer circumference. This slide 129 is made fork-shaped over its region engaging round, its fork cross-section being adapted, above the guide plate 127, to the rectangular cross-section of the larger guide plate 126 and, in the region of overlap with the smaller guide plate 127, to the cross-section of the latter. The fork ends of the slide are respectively designed as catch hooks 130 and engage on opposite sides into straight sliding guides 128 which, having a rectangular hollow cross-section, are cut out in line with one another from the opposite sides of 20 the guide plates 126 and 127.

Arranged in a hollow cross-section of the slide 129 is a helical compression spring 119 which is supported at one end on the end face of the guide plate 126 and at its other end on a support plate 131 of the slide 129. The end forming the pressure face of the slide 129 rests over its surface, under the spring load of the compression spring 119, on the sliding plane of the holding plate 115 and keeps the guide plate 127 at a distance from the holding plate 115. Under excessive tensile forces on the door handle, the spring force of the helical compression spring 119 is overridden and the slide 129 is displaced in the direction of the guide plate 126, after which, in addition, at the end of the slide 129, the outside of the guide plate 127 also runs on the holding plate 115. To make it easier to push the slide 129 onto the holding plate 115 during the mounting of the door handle, the pressure face of the slide 129 is bevelled by means of a rounding 132 on its side running on the holding plate 115. At the same time, the radius of the rounding 132 is made so generous that the pushing-on operation requires only little effort.

Furthermore, the top view of the sliding plane of the holding plate 115 behind which engagement takes place shows, on the sliding plane, the face which is loaded by the end face of the slide 129 and which comprises two part faces spaced from one another, since a circular indentation 133 is cut out from the edge zone of the sliding plane. A substantially reliable tilting support of the slide 129 guided slidably approximately at right angles to the sliding plane is thereby obtained. Also, a rapid and easy mounting of the slide 129 on the sliding rail is possible, since the slide 129 consists of flexurally elastic plastic. As a result, it can be snapped onto the guide plates 126 and 127 in the transverse plane of these, after which the catch hooks 130, after engaging into the sliding guide 128, bring about a reliable retention of the slide 129.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A vehicle door and door handle assembly comprising:

a door handle assembly including a manually engageable handle part, a hook fixed to and projecting laterally from one end of the handle part, a spring biased spacer carried by the hook, and a hollow body door having an exterior door panel with an opening accommodating insertion of the hook and forming a handle recess in the hollow body door adjacent the handle part, said door including a mounting support bearing part adjacent the opening which has a support bearing surface facing inwardly of the exterior door panel, wherein said hook and spring biased spacer are configured to accommodate mounting of the door handle assembly with the hook first inserted laterally through the opening and subsequently moved longitudinally in a direction toward the handle part with the spacer slidably contacting the support bearing surface to clamp the hook against the support bearing surface while permitting limited longitudinal and lateral adjusting movement of the hook.

2. An assembly according to claim 1, comprising a load spring continuously biasing the spacer toward a position clamping the hook against the support bearing surface, wherein the spring force of the load spring is higher than tensile forces taking effect on the support bearing surface during a normal operation of the door handle assembly.

3. An assembly according to claim 2, wherein an end region of the hook is movable into a bearing position on the support bearing surface when the load spring is overridden by excessive tensile forces on the door handle assembly.

4. An assembly according to claim 3, wherein the hook includes an annular guide at an end region thereof, and wherein the spacer is a tappet which is slidably guided coaxially in a clear cross-section of the annular guide and rests on the support bearing surface by means of a tappet end projecting from the annular guide.

5. An assembly according to claim 4, wherein the tappet is guided in a rotation preventing manner, its tappet end being bevelled in regions to form a slide-on plane.

6. An assembly according to claim 4, wherein an annular collar of the tappet limits outward movement of the tappet, wherein the annular collar is provided at an end of the annular guide, and when the load spring is a coaxially arranged helical compression spring integrated into an end region of the hook.

7. An assembly according to claim 1, wherein an end region of the hook includes a sliding guide, and wherein the spacer is a slide which runs on the sliding guide.

8. An assembly according to claim 7, wherein the sliding guide is a sliding rail, said slide engaging around the sliding rail.

9. An assembly according to claim 8, comprising a load spring continuously biasing the spacer toward a position clamping the hook against the support bearing surface, wherein the sliding rail includes two mutually spaced length portions, said load spring being a helical compression spring disposed between the two mutually spaced length portions, the winding cross-section of the spring being guided in a hollow cross-section of the slide, wherein the end region of the hook includes a first support plate, wherein the slide includes a second support plate, wherein the helical compression spring is supported axially between the first and second support plates, wherein the slide includes a pressure face, and wherein the pressure face of the slide is bevelled by means of a rounding on its side running on the support bearing.

10. An assembly according to claim 9, wherein the two mutually spaced length portions of the sliding rail have a differing cross-sectional thickness as compared to one another for accommodating snapping connection of the sliding rail with the slide.

* * * * *